US007352344B2

(12) United States Patent
Chen

(10) Patent No.: US 7,352,344 B2
(45) Date of Patent: Apr. 1, 2008

(54) DRIVER CIRCUIT FOR PLASMA DISPLAY PANELS

(75) Inventor: Bi-Hsien Chen, Ping-Tung Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 464 days.

(21) Appl. No.: 10/907,892

(22) Filed: Apr. 20, 2005

(65) Prior Publication Data

US 2006/0238447 A1 Oct. 26, 2006

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211, 212; 313/567; 315/169.3, 169.4

See application file for complete search history.

(56) References Cited

U.S. PATENT DOCUMENTS

| | | | | |
|---|---|---|---|---|
| 5,670,974 | A | 9/1997 | Ohba et al. | |
| 5,828,353 | A | 10/1998 | Kishi et al. | |
| 6,628,275 | B2 * | 9/2003 | Vossen et al. | 345/211 |
| 6,680,581 | B2 | 1/2004 | Lee et al. | |
| 6,768,270 | B2 * | 7/2004 | Chae | 315/169.3 |
| 6,781,322 | B2 | 8/2004 | Onozawa et al. | |
| 6,933,679 | B2 * | 8/2005 | Lee et al. | 315/169.4 |
| 6,961,031 | B2 * | 11/2005 | Lee et al. | 345/60 |
| 7,023,139 | B2 * | 4/2006 | Lee et al. | 315/169.1 |
| 7,027,010 | B2 * | 4/2006 | Lee | 345/60 |
| 7,123,219 | B2 * | 10/2006 | Lee | 345/76 |
| 7,176,854 | B2 * | 2/2007 | Lee et al. | 345/60 |
| 2003/0071578 | A1 * | 4/2003 | Lee et al. | 315/169.3 |
| 2003/0173905 | A1 * | 9/2003 | Lee et al. | 315/169.3 |
| 2003/0193454 | A1 * | 10/2003 | Lee et al. | 345/63 |
| 2004/0012546 | A1 | 1/2004 | Takagi | |
| 2004/0135746 | A1 * | 7/2004 | Lee et al. | 345/60 |
| 2006/0238447 | A1 | 10/2006 | Chen | |
| 2006/0267874 | A1 * | 11/2006 | Chen et al | 345/68 |

* cited by examiner

*Primary Examiner*—Ricardo Osorio
(74) *Attorney, Agent, or Firm*—Winston Hsu

(57) ABSTRACT

A driver circuit for plasma display panels is provided. The driver circuit includes four switches and an energy recovery circuit coupled to an equivalent capacitor of a plasma display panel. The present energy recovery circuit includes a first unit, coupled to the X side of the equivalent capacitor, for passing current of charging and/or discharging the equivalent capacitor from the X side; a second unit, coupled to the Y side of the equivalent capacitor, for passing current of charging and/or discharging the equivalent capacitor from the Y side; and a third unit coupled to the first unit, the second unit and ground, the third unit comprising a capacitor, capable of charging and/or discharging the equivalent capacitor from the X side and/or the Y side.

23 Claims, 12 Drawing Sheets

DRIVER CIRCUIT FOR PLASMA DISPLAY PANELS

BACKGROUND OF INVENTION

1. Field of the Invention

The present invention relates to a driver circuit, and more particularly, to a driver circuit for plasma display panels.

2. Description of the Prior Art

In recent years, there has been an increasing demand for planar matrix displays such as plasma display panels (PDP), liquid-crystal displays (LCD) and electroluminescent displays (EL display) in place of cathode ray tube terminals (CRT) due to the advantage of the thin appearance of the planar matrix displays. This kind of planar display is, in general, designed to achieve display through discharge glow in which charges accumulated over electrodes are released with application of a given voltage.

In a PDP display, charges are accumulated according to display data, and a sustaining discharge pulse is applied to paired electrodes in order to initiate discharge glow for display. As far as the PDP display is concerned, it is required to apply a high voltage to the electrodes. In particular, a pulse-duration of several microseconds is adopted usually. Hence the power consumption of the PDP display is quite considerable. Energy recovering (power saving) is therefore sought for. Many designs and patents have been developed for providing methods and apparatus of energy recovering for PDP. One of the examples is U.S. Pat. No. 5,828,353, "Drive Unit for Planar Display" by Kishi, et al., which is included herein by reference.

Please refer to FIG. 1. FIG. 1 is a block diagram of a prior art driver circuit 100. An equivalent capacitor of a plasma display panel is marked as Cpanel. The conventional driver circuit 100 includes four switches S1 to S4 for passing current, an X-side energy recovery circuit 110 and a Y-side energy recovery circuit 120 for charging/discharging the capacitor Cpanel from the X side of the capacitor Cpanel and the Y side of the capacitor Cpanel respectively. S5, S6, S7 and S8 are switches for passing current. D5, D6, D7 and D8 are diodes. V1 and V2 are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the equivalent capacitor Cpanel of the PDP by the conventional driver circuit 100 illustrated in FIG. 1.

Step 200: Start;

Step 210: Keep the voltage potentials at the X side and the Y side of the capacitor Cpanel at ground by turning on the switches S3 and S4 and turning off other switches;

Step 220: Charge the X side of the capacitor Cpanel by the capacitor C1 and keep the voltage potential at the Y side of the capacitor Cpanel at ground by turning on the switches S6 and S4 and turning off other switches; wherein the voltage potential at the X side of the capacitor Cpanel goes up to V1 accordingly;

Step 230: Ignite the equivalent capacitor Cpanel of the PDP from the X side by turning on the switches S1 and S4 and turning off other switches; wherein the voltage potential at the X side of the capacitor Cpanel keeps at V1 and the voltage potential at the Y side of the capacitor Cpanel keeps at ground accordingly;

Step 240: Discharge the capacitor Cpanel from the X side and keep the voltage potential at the Y side of the capacitor Cpanel at ground by turning on the switches S5 and S4 and turning off other switches; wherein the voltage potential at the X side of the capacitor Cpanel goes down to ground accordingly;

Step 250: Keep the voltage potentials at the X side and the Y side of the capacitor Cpanel at ground by turning on the switches S3 and S4 and turning off other switches;

Step 260: Charge the Y side of the capacitor Cpanel by the capacitor C2 and keep the voltage potential at the X side of the capacitor Cpanel at ground by turning on the switches S8 and S3 and turning off other switches; wherein the voltage potential at the Y side of the capacitor Cpanel goes up to V2 accordingly;

Step 270: Ignite the equivalent capacitor Cpanel of the PDP from the Y side by turning on the switches S2 and S3 and turning off other switches; wherein the voltage potential at the Y side of the capacitor Cpanel keeps at V2 and the voltage potential at the X side of the capacitor Cpanel keeps at ground accordingly;

Step 280: Discharge the capacitor Cpanel from the Y side and keep the voltage potential at the X side of the capacitor Cpanel at ground by turning on the switches S7 and S3 and turning off other switches; wherein the voltage potential at the Y side of the capacitor Cpanel goes down to ground accordingly;

Step 290: Keep the voltage potentials at the X side and the Y side of the capacitor Cpanel at ground by turning on the switches S3 and S4 and turning off other switches;

Step 295: End.

Please refer to FIG. 3. FIG. 3 shows a diagram illustrating the voltage potentials at the X side and the Y side of the capacitor Cpanel, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Conventionally, the energy recovery (power saving) circuit provides two individual channels of charging and discharging the equivalent capacitor respectively (energy-forward channel and energy-backward channel) for each side of the equivalent capacitor Cpanel. Therefore, the amount of required components is quite large. Furthermore, the area of capacitors C1 and C2 is usually considerable. Hence the cost of energy recovery circuit is not easy to reduce.

SUMMARY OF INVENTION

It is therefore a primary objective of the claimed invention to provide a driver circuit for plasma display panels.

Briefly described, the claimed invention discloses a driver circuit for plasma display panels. The driver circuit includes four switches and an energy recovery circuit coupled to an equivalent capacitor of a plasma display panel. The present energy recovery circuit includes a first unit, coupled to the X side of the equivalent capacitor, for passing current of charging and/or discharging the equivalent capacitor from the X side; a second unit, coupled to the Y side of the equivalent capacitor, for passing current of charging and/or discharging the equivalent capacitor from the Y side; and a third unit coupled to the first unit, the second unit and ground, the third unit comprising a capacitor, capable of charging and/or discharging the equivalent capacitor from the X side and/or the Y side.

It is an advantage of the present invention that all of the energy-forward channels and the energy-backward channels of the X-side driver and the Y-side driver of the energy recovering circuit utilize the same capacitor for energy recovery. The drawback of the great amount of required components in prior art is moderated, and the area of chips is hence reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
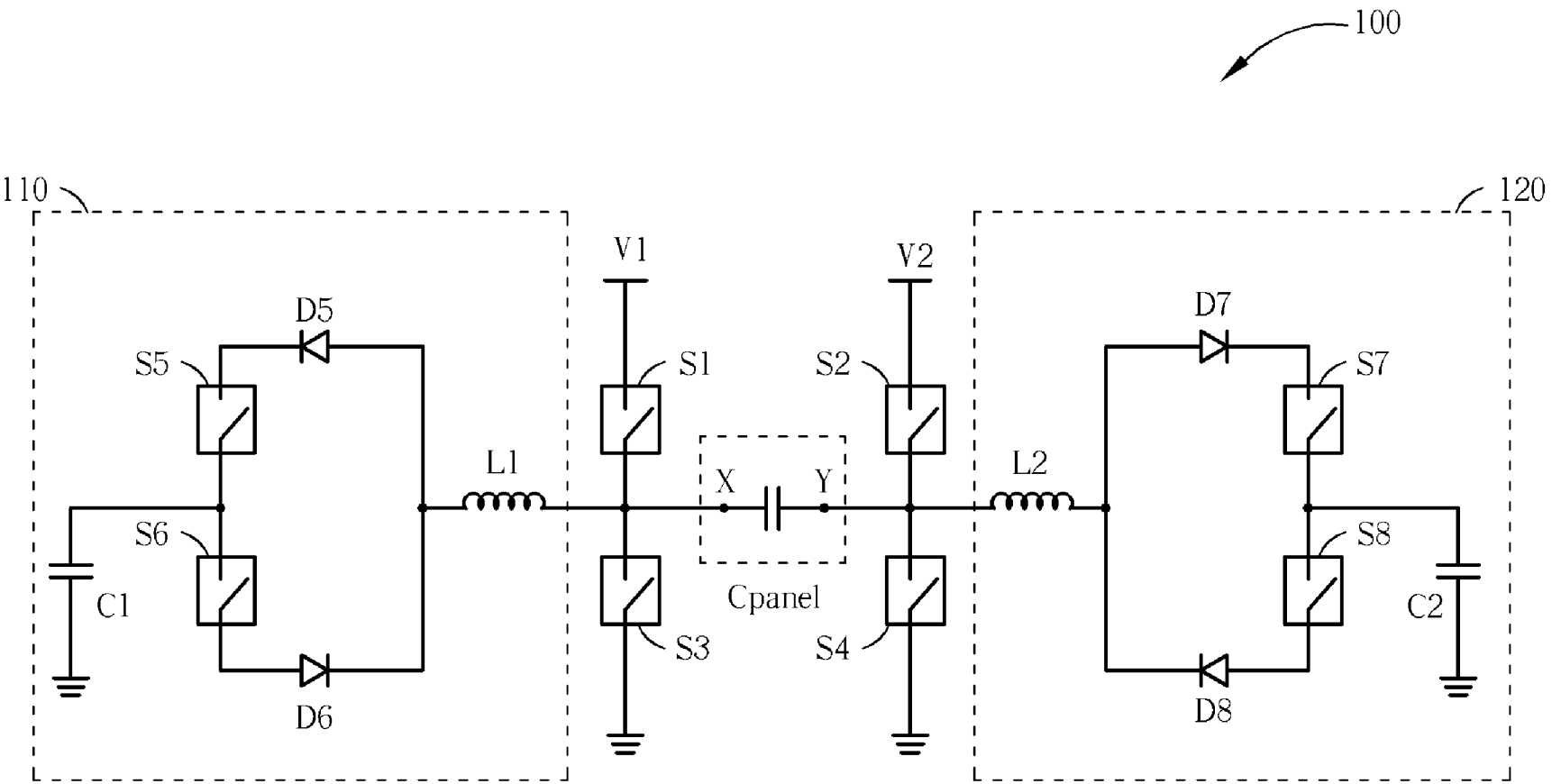
Fig. 1 Prior art
FIG. 1 is a block diagram of a prior art energy recovery circuit with an equivalent capacitor of a PDP.
Figure 2:
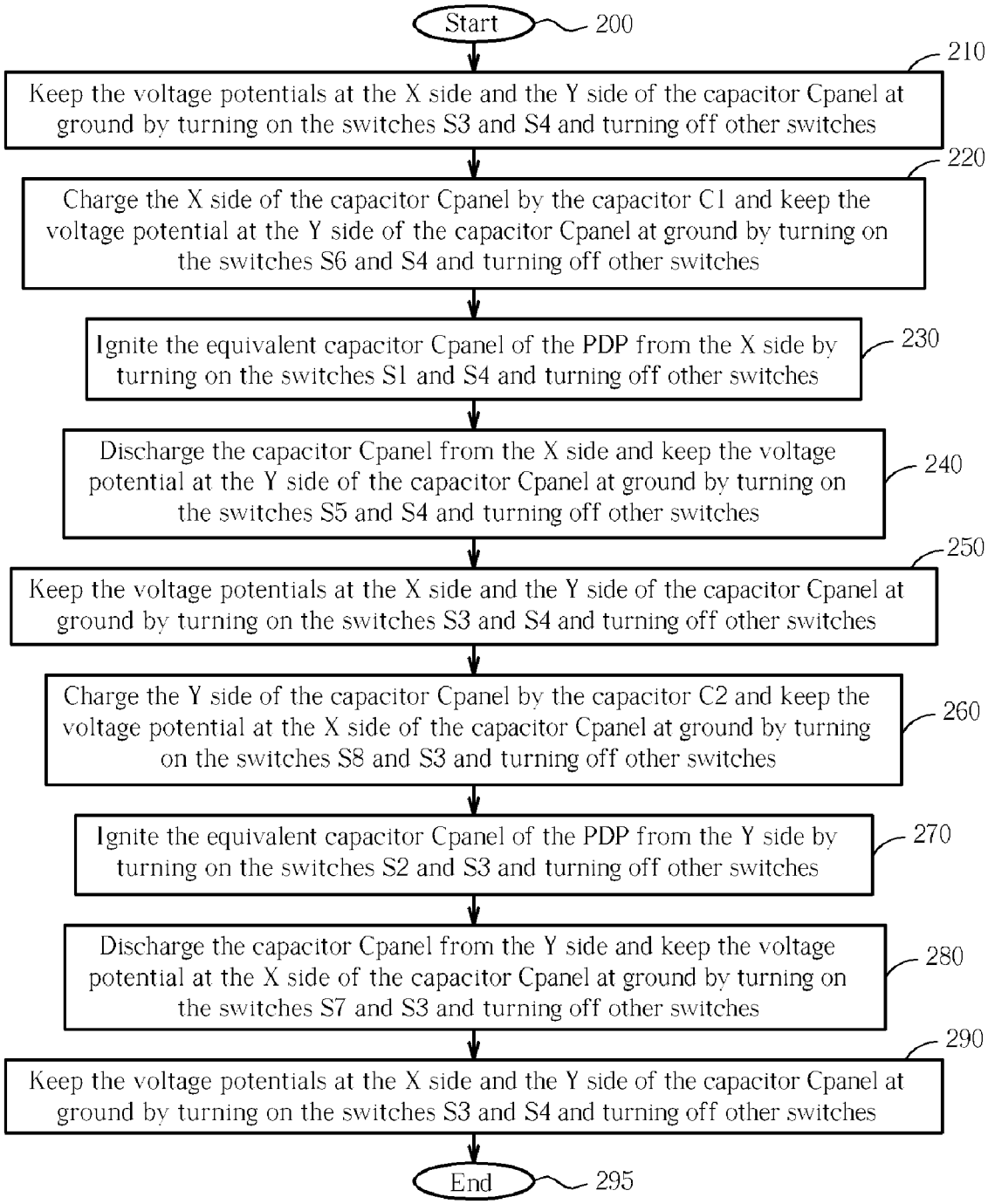
Fig. 2 Prior art
FIG. 2 is a flowchart of a prior art method of generating the sustaining pulses of the equivalent capacitor Cpanel.
Figure 3:
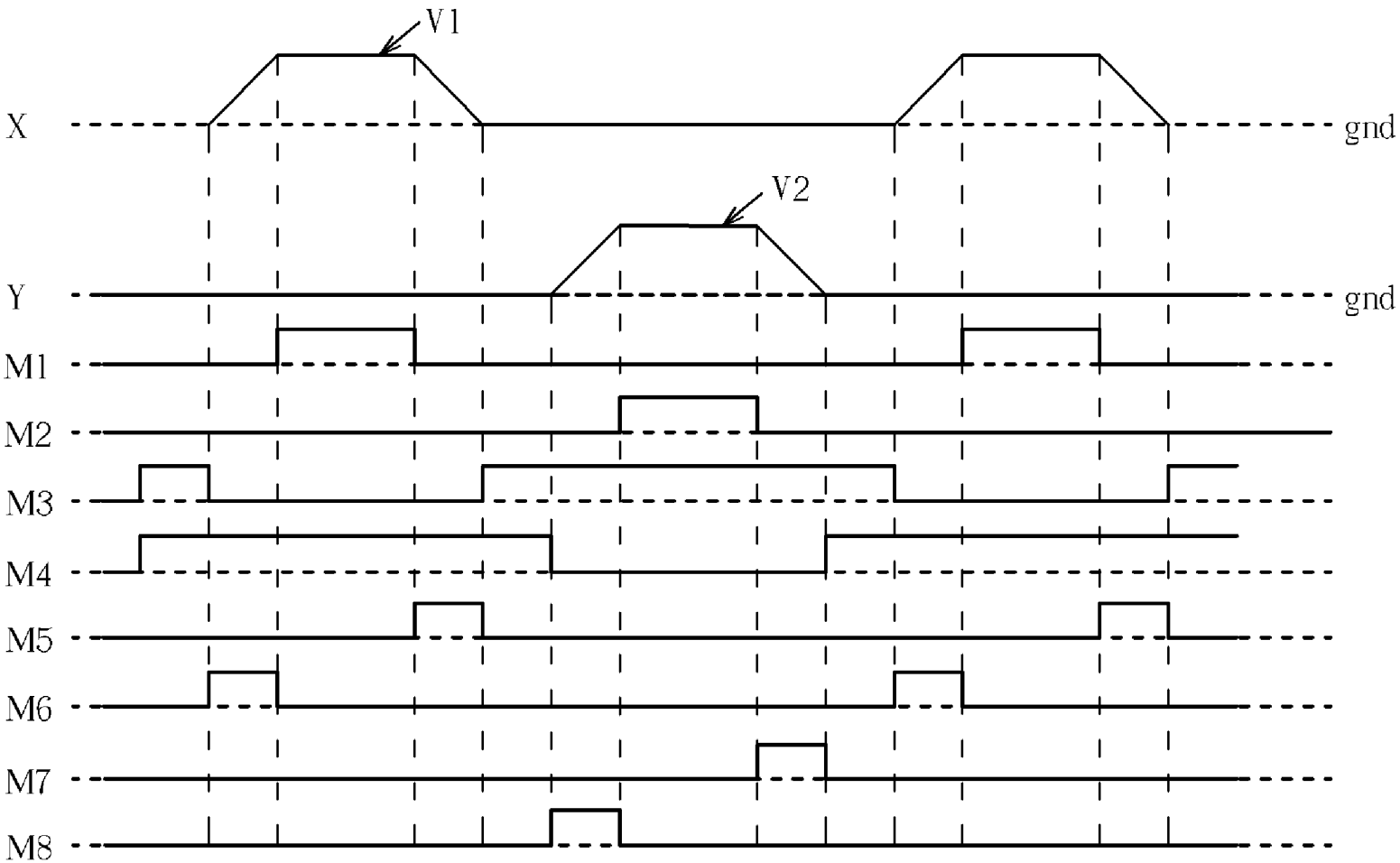
Fig. 3 Prior art
FIG. 3 is a diagram illustrating the voltage potentials at sides of the capacitor Cpanel and the control signals of the switches.
Figure 4:
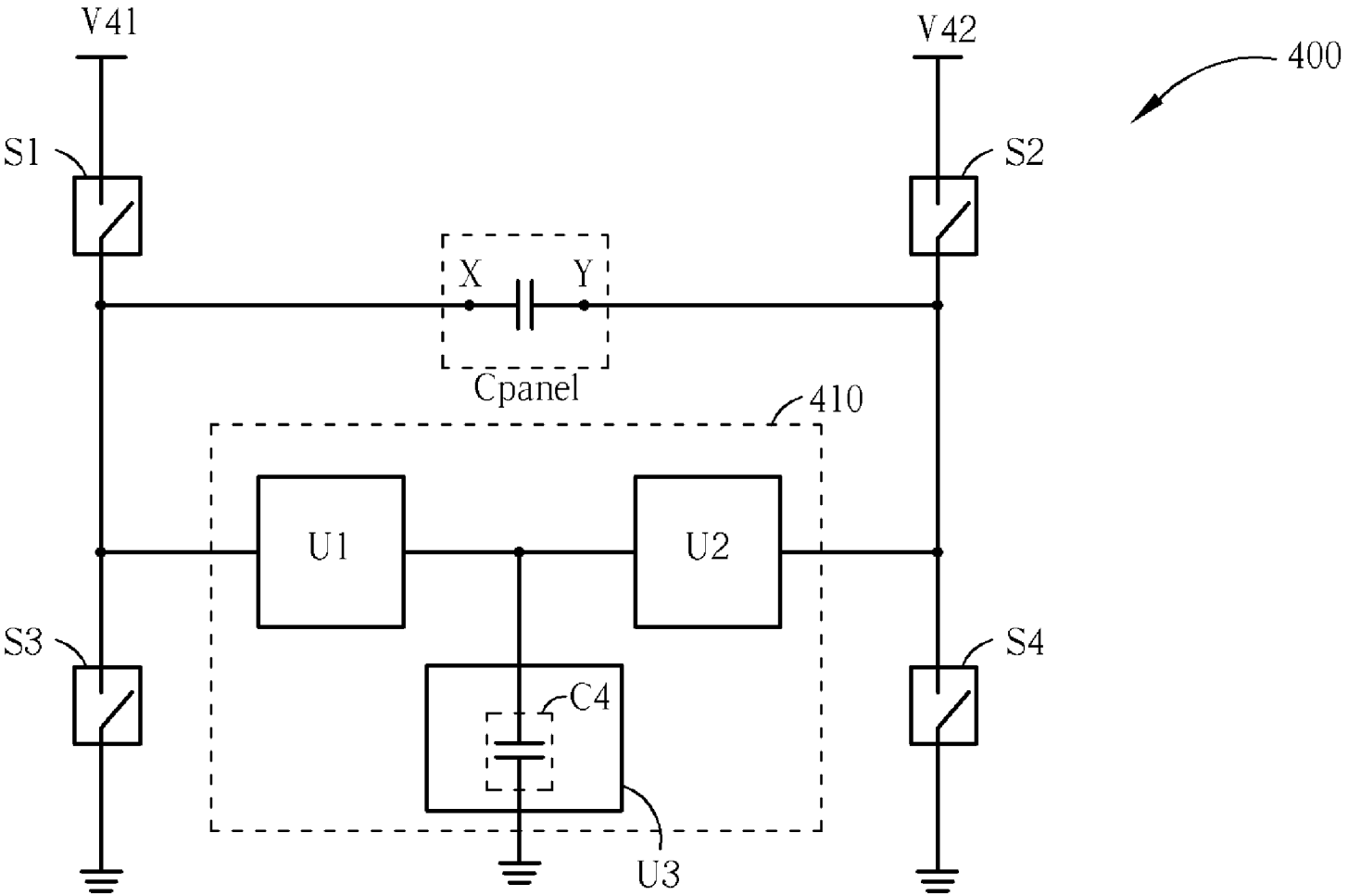
FIG. 4 is a block diagram of a present invention driver circuit with an equivalent capacitor of a PDP.

Please refer to FIG. 4. FIG. 4 is a block diagram of the present invention driver circuit 400 and an equivalent capacitor of a PDP (plasma display panel), Cpanel. Two voltage sources V41 and V42 are different or equivalent voltage sources to the present driver circuit 400 and the equivalent capacitor Cpanel. The functions and connections of the switches S1, S2, S3 and S4 are similar to the functions and connections of the switches S1, S2, S3 and S4 illustrated in FIG. 1. The present invention driver circuit 400 includes an energy recovery circuit 410 for charging/discharging the equivalent capacitor Cpanel. The energy recovery circuit 410 includes three units. A first unit U1, coupled to the X side of the equivalent capacitor Cpanel, is for passing current of charging and/or discharging the equivalent capacitor Cpanel from the X side. A second unit U2, coupled to the Y side of the equivalent capacitor, is for passing current of charging and/or discharging the equivalent capacitor from the Y side. A third unit U3 is coupled to the first unit U1, the second unit U2 and ground, including a capacitor C4. The capacitor C4 is capable of charging and/or discharging the equivalent capacitor Cpanel from the X side and/or the Y side.

While there are two capacitors C1 and C2 are needed for energy recovery in the two conventional energy recovery circuits 110 and 120 of the driver circuit 100 respectively, only one capacitor C4 is adopted as a voltage source in the driver circuit 400 of the present invention. The unit U1 combined with the unit U3 provides an energy-forward channel and an energy-backward channel of the X side of the equivalent capacitor Cpanel, as the unit U2 combined with the unit U3 provides an energy-forward channel and an energy-backward channel of the Y side of the equivalent capacitor Cpanel. Both the unit U1 and the unit U2 need to unite the unit U3, which includes the capacitor C4, to implement the energy recovery for the capacitor Cpanel. That is, all the energy-forward channels and the energy-backward channels of the X side and the Y side of the equivalent capacitor Cpanel share the same capacitor, C4, in the energy recovery circuit 410 of the present invention.

Figure 5:
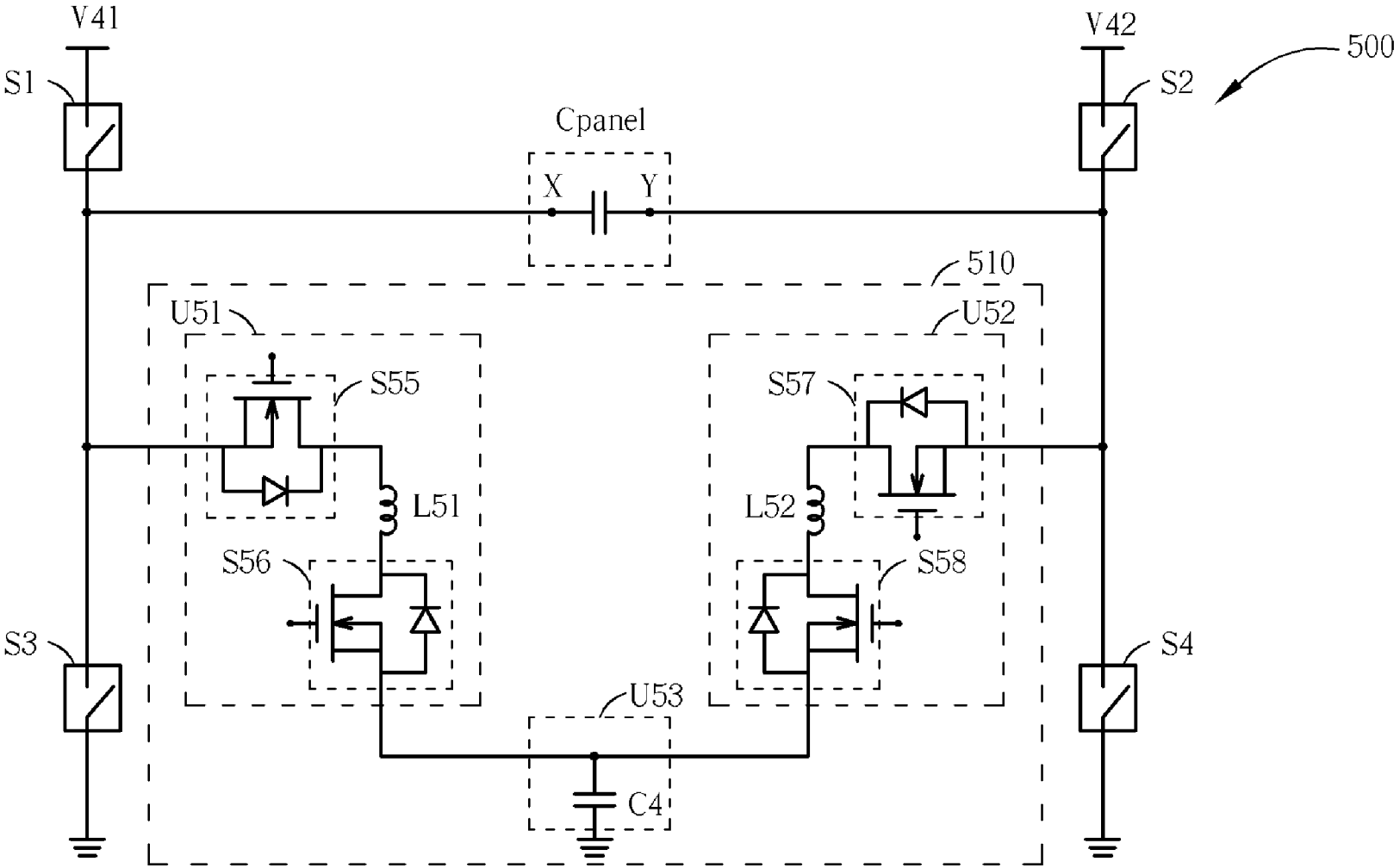
FIG. 5 is a block diagram of the first embodiment of the present invention driver circuit with an equivalent capacitor of a PDP.

For passing both the current charging the capacitor Cpanel and the current discharging the capacitor Cpanel, each of the unit U1 and the unit U3 has to be equipped with a bidirectional switch, or two switches that together implement the bi-directional control. Please refer to FIG. 5. FIG. 5 is a block diagram of the first embodiment 500 of the present invention driver circuit. In this embodiment, a unit U51 includes two switches S55 and S56 and an inductor L51 coupled in series, and a unit U52 includes two switches S57 and S58 and an inductor L52 coupled in series as well. Both of the units U51 and U52 connect to a unit U53 including a capacitor C4. The switches S55 to S58 of the units U51 and U52 can properly control the direction of current from/toward the capacitor C4 to fulfill the job of charging/discharging the X-side and/or the Y-side of the equivalent capacitor Cpanel.

Figure 6:
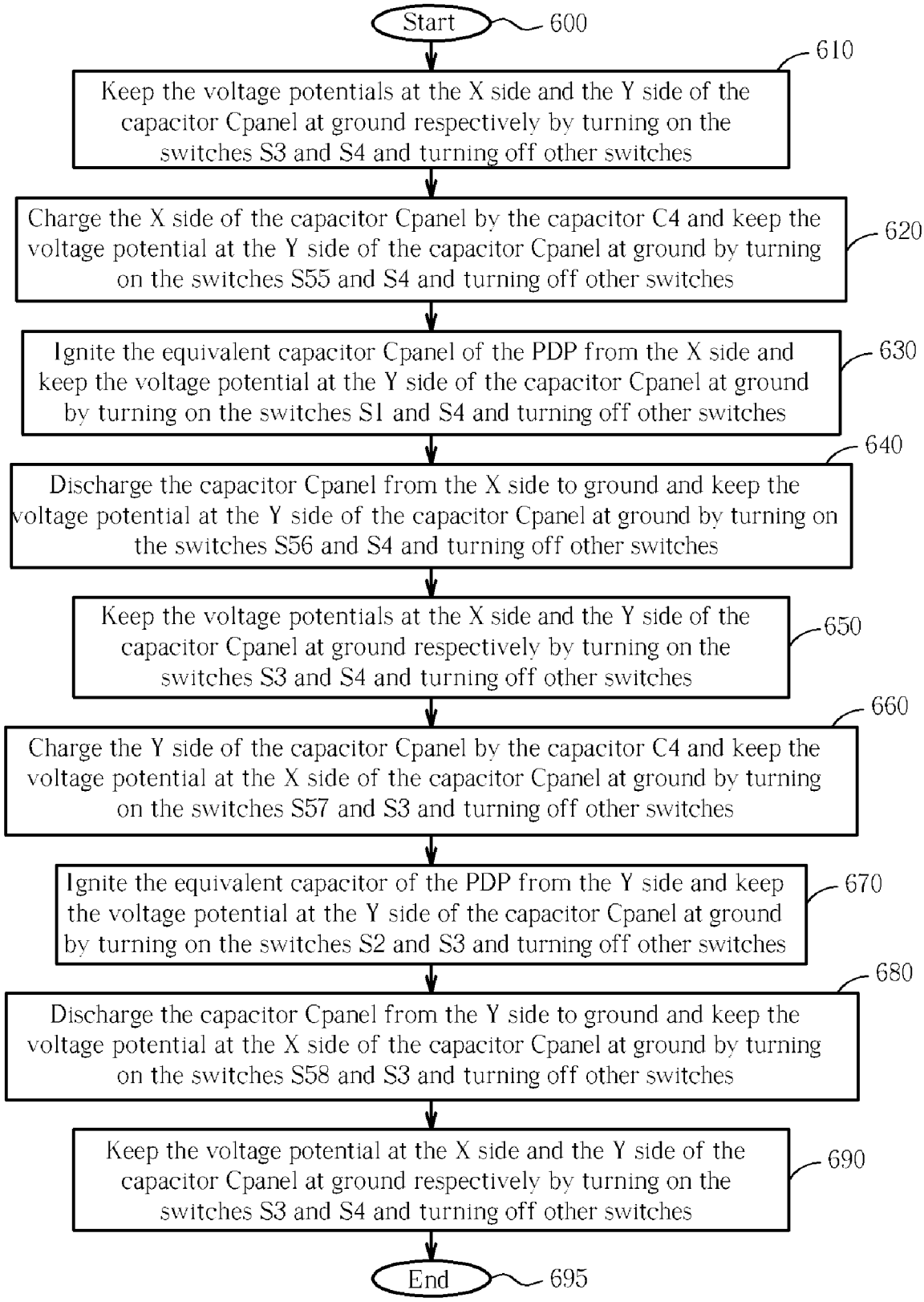
FIG. 6 is a flowchart of the present invention method of generating the sustaining pulses of the equivalent capacitor Cpanel.

Please refer to FIG. 6. FIG. 6 is a flowchart of generating the sustaining pulses of the equivalent capacitor Cpanel of the PDP by the first embodiment 500 of the present invention driver circuit illustrated in FIG. 5.

Step 600: Start;

Step 610: Keep the voltage potentials at the X side and the Y side of the capacitor Cpanel at ground by turning on the switches S3 and S4;

Step 620: Charge the X side of the capacitor Cpanel by the capacitor C4 and keep the voltage potential at the Y side of the capacitor Cpanel at ground by turning on the switches S55 and S4; wherein the voltage potential at the X side of the capacitor Cpanel goes up to V41 and the voltage potential at the Y side of the capacitor Cpanel keeps at ground accordingly;

Step 630: Ignite the equivalent capacitor Cpanel of the PDP from the X side and keep the voltage potential at the Y side of the capacitor Cpanel at ground by turning on the switches S1 and S4; wherein the voltage potential at the X side of the capacitor Cpanel keeps at V41 and the voltage potential at the Y side of the capacitor Cpanel keeps at ground accordingly;

Step 640: Discharge the capacitor Cpanel from the X side to ground and keep the voltage potential at the Y side of the capacitor Cpanel at ground by turning on the switches S56 and S4; wherein the voltage potential at the X side of the capacitor Cpanel goes down to ground and the voltage potential at the Y side of the capacitor Cpanel keeps at ground accordingly;

Step 650: Keep the voltage potentials at the X side and the Y side of the capacitor Cpanel at ground by turning on the switches S3 and S4;

Step 660: Charge the Y side of the capacitor Cpanel by the capacitor C4 and keep the voltage potential at the X side of the capacitor Cpanel at ground by turning on the switches S57 and S3; wherein the voltage potential at the Y side of the capacitor Cpanel goes up to V42 and the voltage potential at the X side of the capacitor Cpanel keeps at ground accordingly;

Step 670: Ignite the equivalent capacitor of the PDP from the Y side and keep the voltage potential at the Y side of the capacitor Cpanel at ground by turning on the switches S2 and S3; wherein the voltage potential at the Y side of the capacitor Cpanel keeps at V42 and the voltage potential at the X side of the capacitor Cpanel keeps at ground accordingly;

Step 680: Discharge the capacitor Cpanel from the Y side to ground and keep the voltage potential at the X side of the capacitor Cpanel at ground by turning on the switches S58 and S3; wherein the voltage potential at the Y side of the capacitor Cpanel goes down to ground and the voltage potential at the X side of the capacitor Cpanel keeps at ground accordingly;

Step 690: Keep the voltage potential at the X side and the Y side of the capacitor Cpanel at ground respectively by turning on the switches S3 and S4;

Step 695: End.

In the unit U51 of the first embodiment 500 of the present invention energy recovery circuit, the inductor L51 and the two switches S55 and S56 are coupled in series. Note that no matter what the order of the three components included in the unit U51 is, the unit U51 fulfills its job successfully as long as the two switches are for passing currents in opposite directions. In the first embodiment 500 of the claimed driver circuit, each of the switches S55 and S56 is a N-type metal oxide semiconductor (NMOS) with a parasitic diode. When charging the X side of the equivalent capacitor Cpanel, the switch S55 is turned on for passing the current from the capacitor C4, along the parasitic diode of the NMOS of the switch S56, the inductor L51 and the switch S55 to the X side of the equivalent capacitor Cpanel. On the contrary, when discharging the X side of the equivalent capacitor Cpanel, the switch S56 is turned on for passing the current from the X side of the equivalent capacitor Cpanel, along the parasitic diode of the NMOS of the switch S55, the inductor L51 and the switch S56 to the capacitor C4. The structure and operations of the components of the unit U52 are similar to the structure and operations of the components of the unit U51. When charging the Y side of the equivalent capacitor Cpanel, the switch S57 is turned on for passing the current from the capacitor C4, along the parasitic diode of the NMOS of the switch S58, the inductor L52 and the switch S57 to the Y side of the equivalent capacitor Cpanel. And when discharging the Y side of the equivalent capacitor Cpanel, the switch S58 is turned on for passing the current from the Y side of the equivalent capacitor Cpanel, along the parasitic diode of the NMOS of the switch S57, the inductor L52 and the switch S58 to the capacitor C4.

Figure 7:
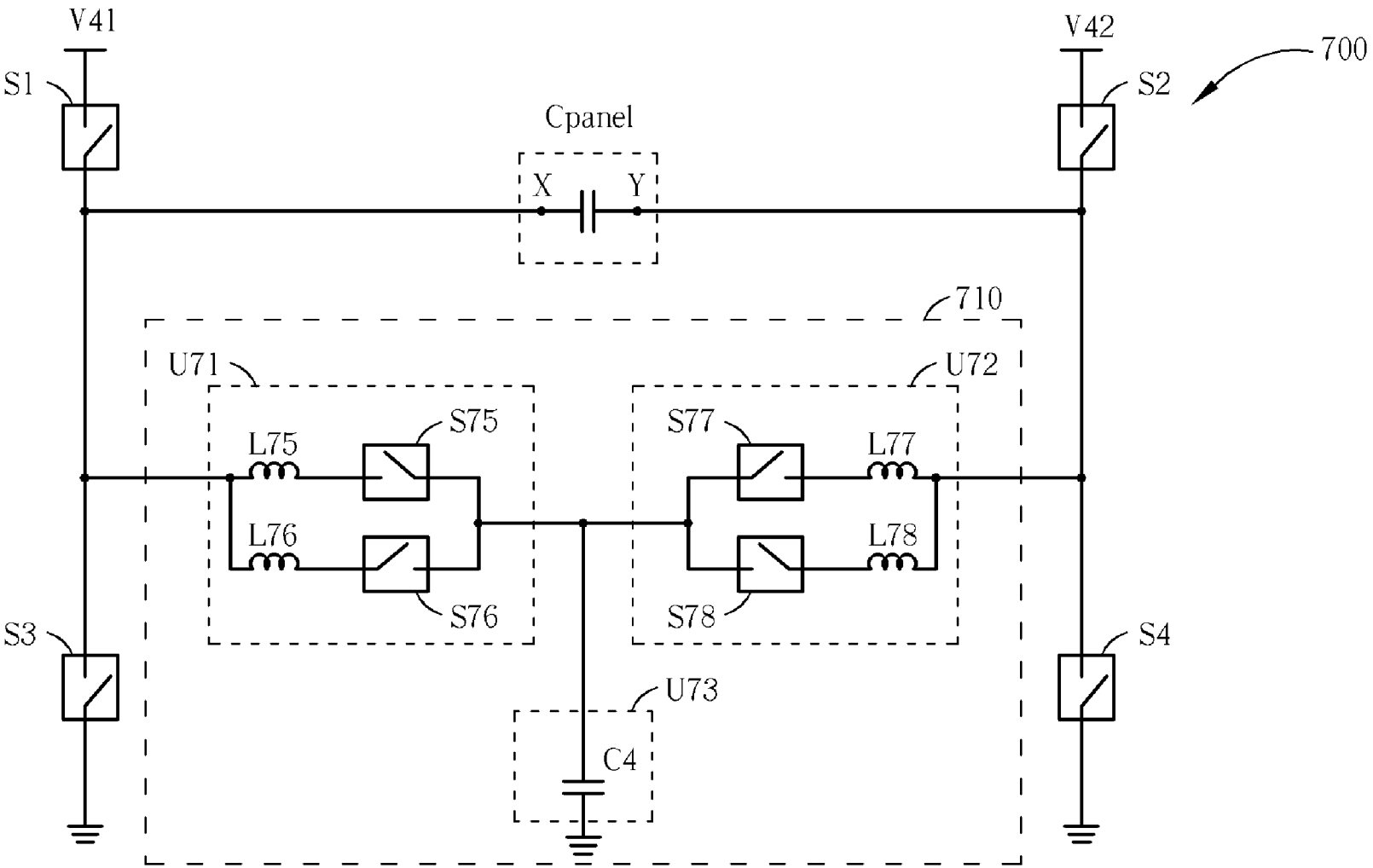
FIG. 7 is a block diagram of the second embodiment of the present invention driver circuit with an equivalent capacitor of a PDP.

The slopes of the curves of the voltage potentials in the charging stages and the discharging stages are decided in accordance with the inductances of adopted inductors of the energy recovery circuit of the present invention driver circuit. Please refer to FIG. 7. FIG. 7 is a block diagram of a second embodiment 700 of the present invention driver circuit with an equivalent capacitor, Cpanel, of a PDP. The energy recovery circuit 710 of the present invention includes three units: the unit U71, the unit U72 and the unit U73. The unit U73 includes only a capacitor C4 as the unit U53 of the energy recovery circuit 510 in FIG. 5. When charging the X side of the capacitor Cpanel, the switch S75 is turned on, and the X side of the capacitor Cpanel is charged by the capacitor C4 through the inductor L75. When discharging the X side of the capacitor Cpanel, the switch S76 is turned on for passing current from the X side of the capacitor Cpanel through the inductor L76 toward the capacitor C4. Similarly, when charging the Y side of the capacitor Cpanel, the switch S77 is turned on, and the Y side of the capacitor Cpanel is charged by the capacitor C4 through the inductor L77. And when discharging the Y side of the capacitor Cpanel, the switch S78 is turned on for passing current from the Y side of the capacitor Cpanel through the inductor L78 toward the capacitor C4. As long as the inductances of the four inductors are well designed, the slopes of the curves of the voltage potentials at the X side and the Y side of the equivalent capacitor Cpanel in the charging stages and the discharging stages can meet requirements appropriately.

Figure 8:
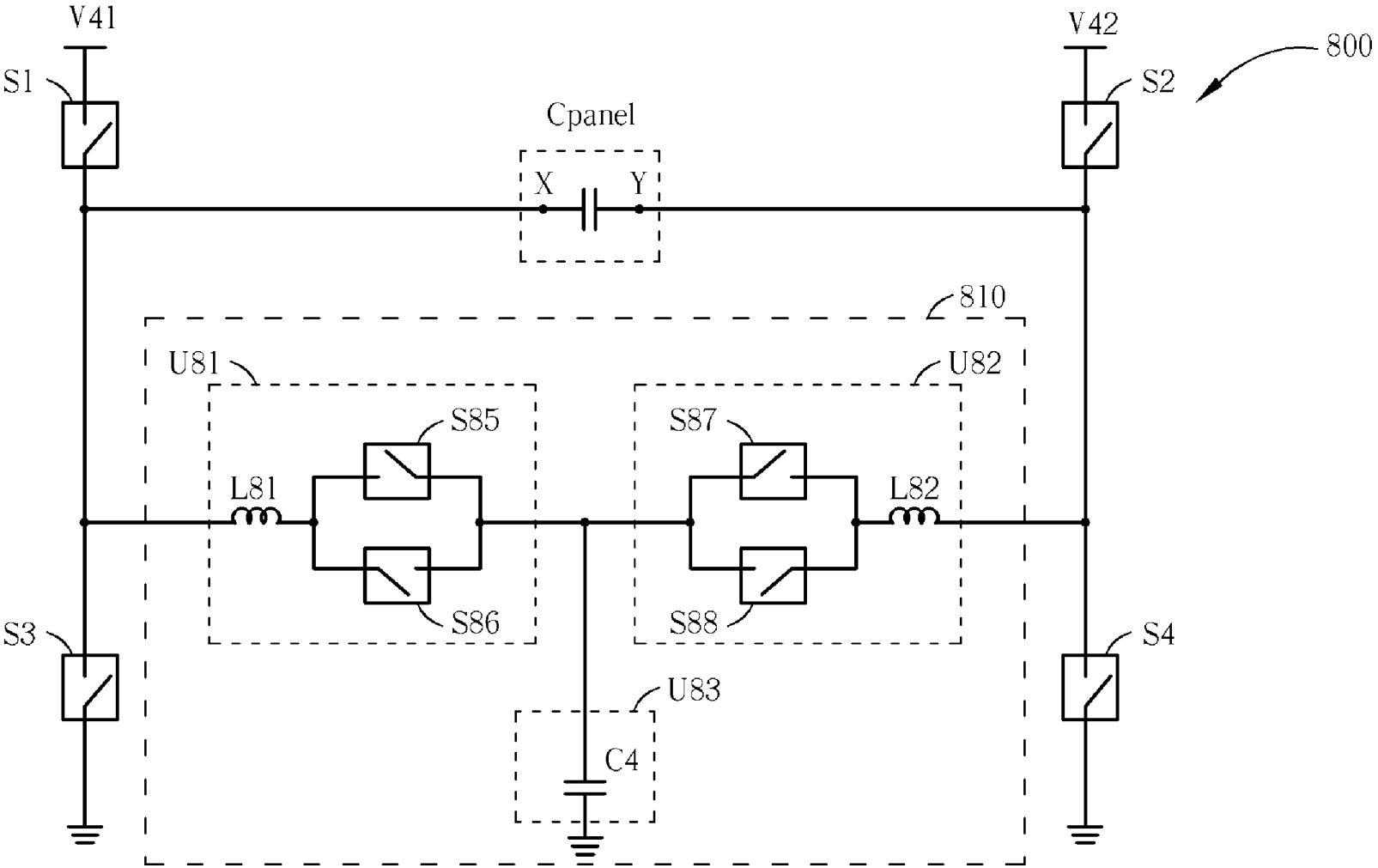
FIG. 8 is a block diagram of a third embodiment of the present invention driver circuit with an equivalent capacitor of a PDP.

Please refer to FIG. 8. FIG. 8 illustrates another embodiment of the present invention driver circuit 800. The difference between the energy recovery circuit 810 and the energy recovery circuit 710 is that each of the two units U81 and U82 adopts only one inductor L81 and L82 respectively rather than two. Therefore, the curves of the voltage potentials in the charging stage and the discharging stage of one side of the capacitor Cpanel are identical, while the curves of the voltage potentials in the charging stages or the discharging stages of different sides of the capacitor Cpanel may be different.

Figure 9:
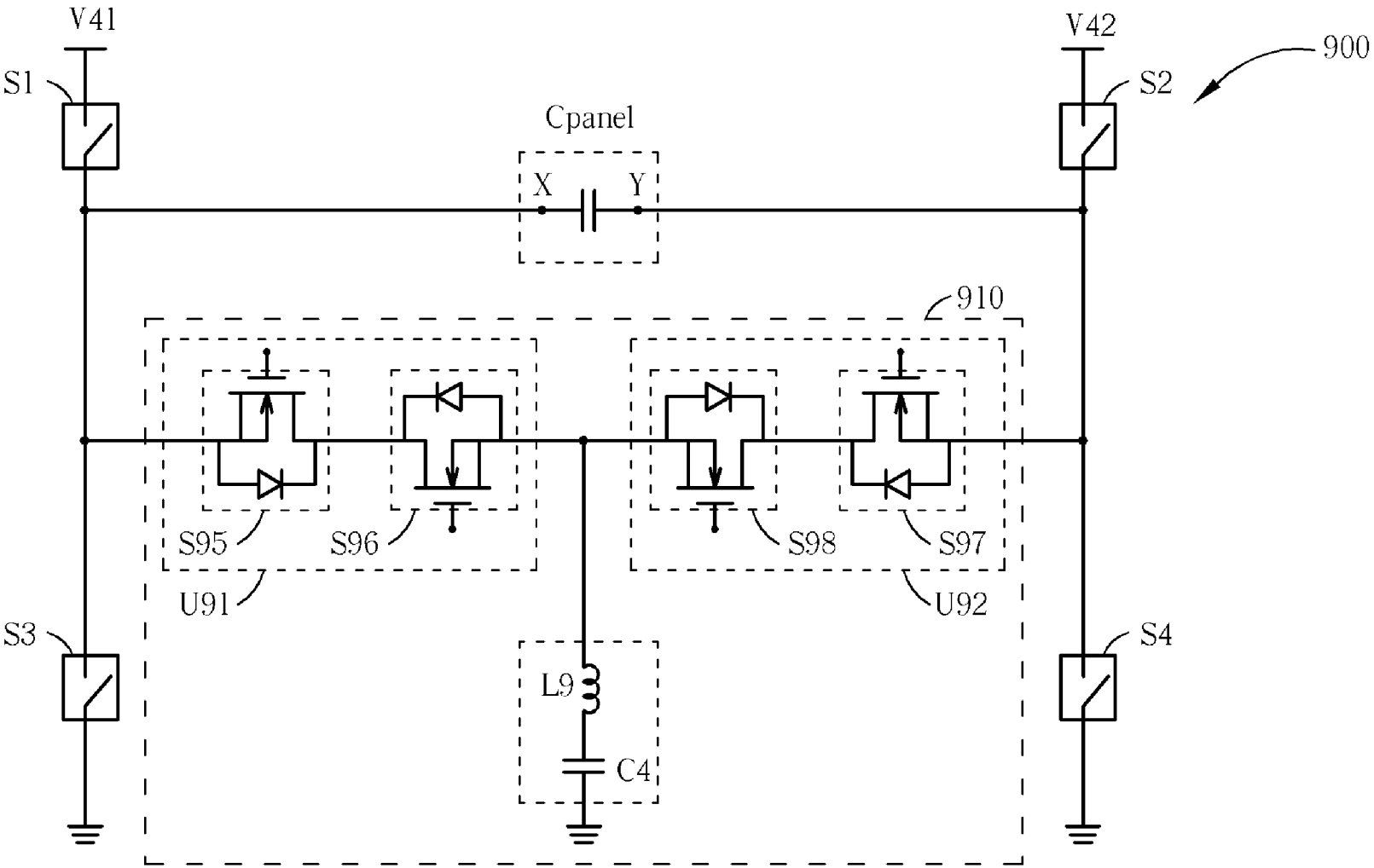
FIG. 9 is a block diagram of a fourth embodiment of the present invention driver circuit with an equivalent capacitor of a PDP.

Please refer to FIG. 9. FIG. 9 is a block diagram of a fourth embodiment 900 of the present invention driver circuit with an equivalent capacitor Cpanel of a PDP. In this embodiment, the unit U93 includes not only a capacitor C4 but also an inductor L9. Each of the units U91 and U92 adopts a bidirectional switch. In FIG. 9, the bidirectional switch of the unit U91 is implemented by two switches S95 and S96, and the bidirectional switch of the unit U92 is implemented by two switches S97 and S98. Compared to the aforementioned energy recovery circuits, the amount of adopted components of the energy recovery circuit 910 is further reduced. When charging the X side of the capacitor Cpanel by the capacitor C4 and keeping the voltage potential at the Y side of the capacitor Cpanel at ground, the switches S95 and S4 are turned on. When discharging the capacitor Cpanel from the X-side to ground and keeping the voltage potential at the Y-side of the capacitor Cpanel at ground, the switches S96 and S4 are turned on. On the other side, when charging the Y side of the capacitor Cpanel by the capacitor C4 and keeping the voltage potential at the X side of the capacitor Cpanel at ground, the switches S97 and S3 are turned on. And when discharging the capacitor Cpanel from the Y side to ground and keeping the voltage potential at the X side of the capacitor Cpanel at ground, the switches S98 and S3 are turned on.

Figure 10:
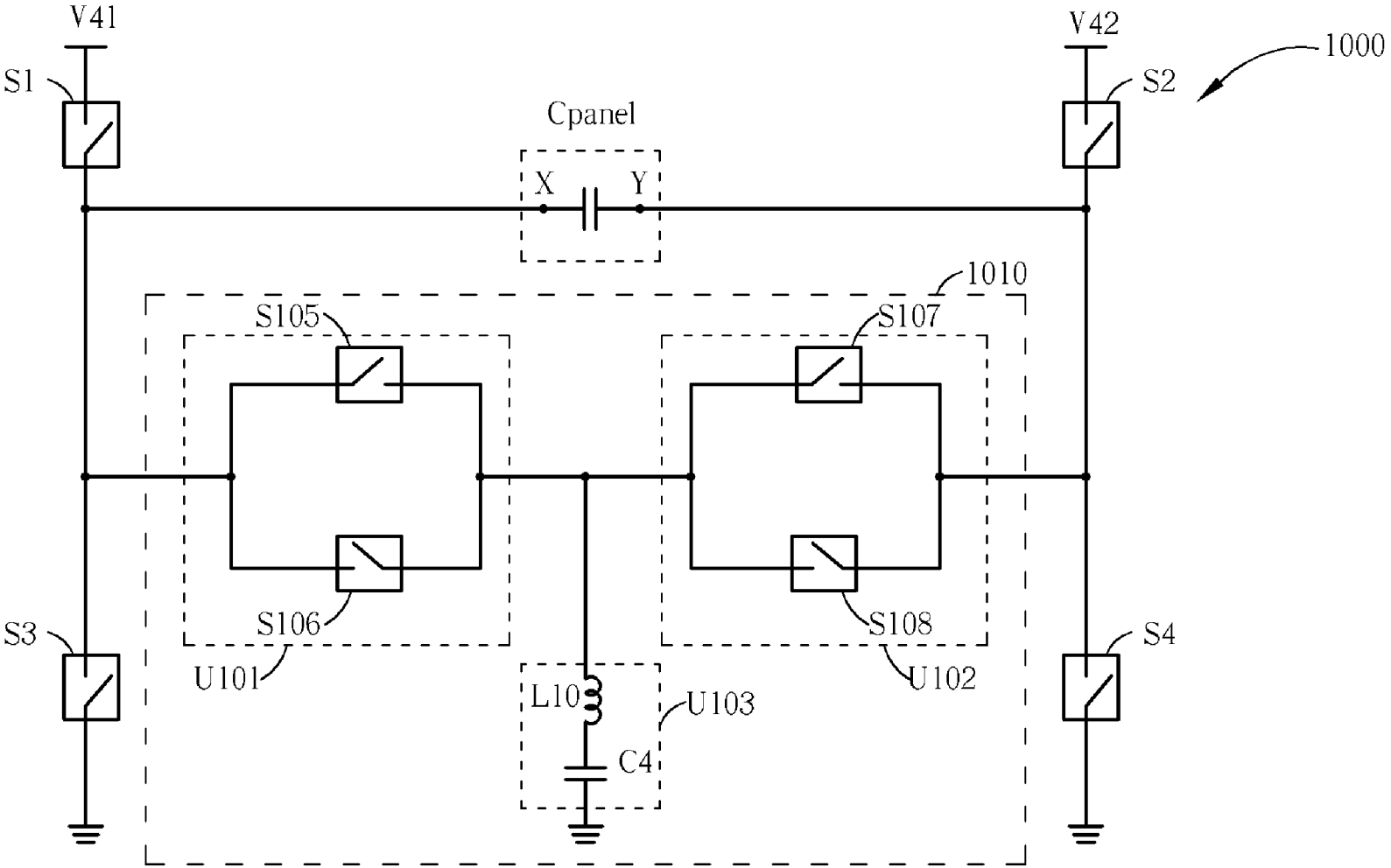
FIG. 10 is a block diagram of a fifth embodiment of the present invention driver circuit with an equivalent capacitor of a PDP.

Please refer to FIG. 10. FIG. 10 is a block diagram of a fifth embodiment 1000 of the present invention driver circuit with an equivalent capacitor Cpanel of a PDP. In the units U91 and U92 of the claimed energy recovery circuit 1010 of the driver circuit 1000, the bidirectional switches utilized for passing currents toward and from the capacitor Cpanel are implemented by two parallel switches. The switches S95, S96, S97 and S98 are illustrated by simple switch symbols in FIG. 9 instead of symbols of transistors.

Figure 11:
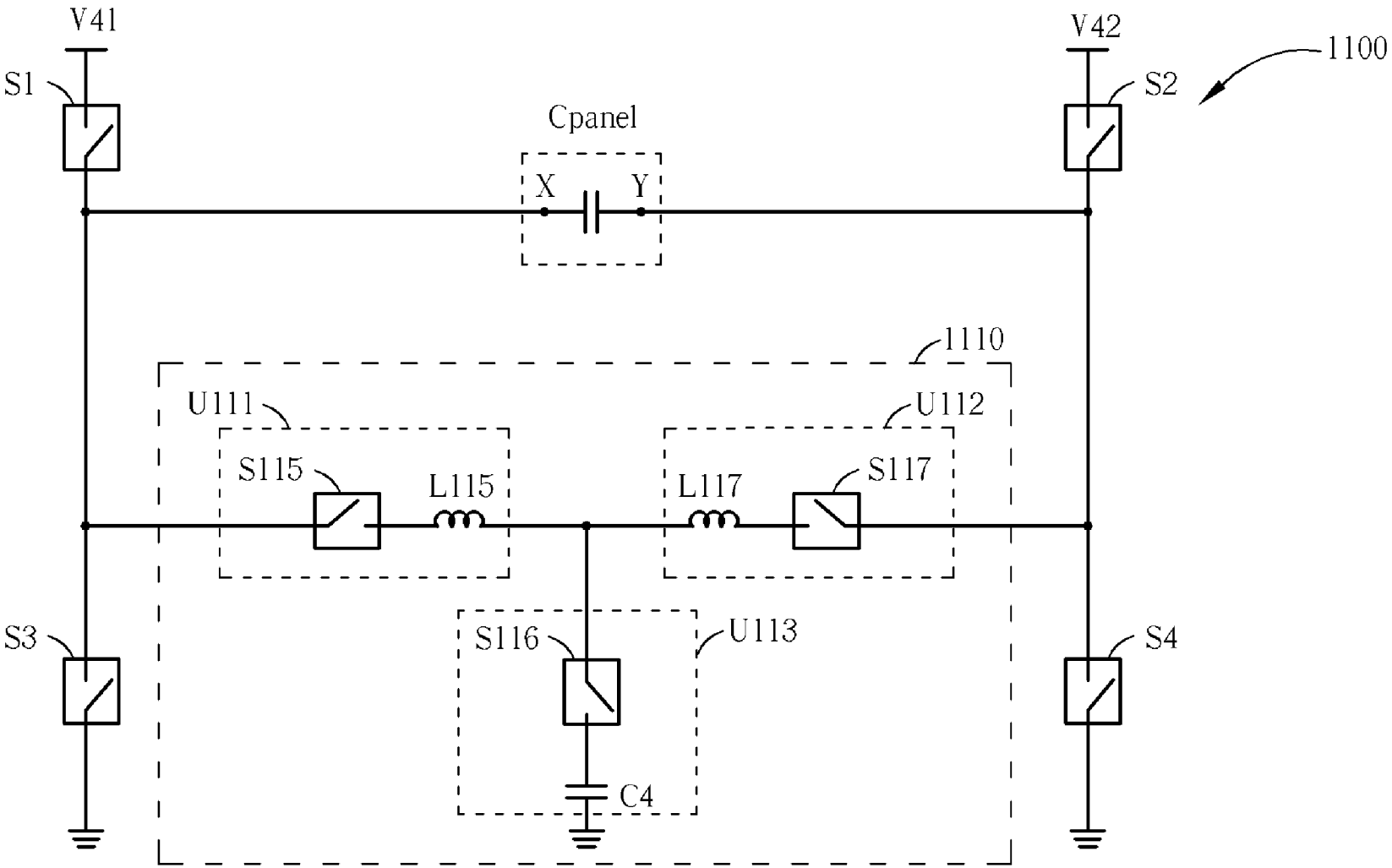
FIG. 11 is a block diagram of a sixth embodiment of the present invention driver circuit with an equivalent capacitor of a PDP.

Please refer to FIG. 11. FIG. 11 illustrated an embodiment 1100 of the present invention driver circuit. In the energy recovery circuit 1110 of the driver circuit 1100, the unit U113 includes a capacitor C4 and a switch S116. Therefore each of the units U111 and U112 only needs to adopt one switch and an inductor. When charging/discharging the X side of the capacitor Cpanel by the capacitor C4, the switch S116 and the switch S115 are turned on for passing current toward/from the X side of the capacitor Cpanel from/toward the capacitor C4. In a similar manner, the switch S116 and the switch S117 are turned on for passing current toward/from the Y side of the capacitor Cpanel from/toward the capacitor C4 when charging/discharging the Y side of the capacitor Cpanel by the capacitor C4.

Figure 12:
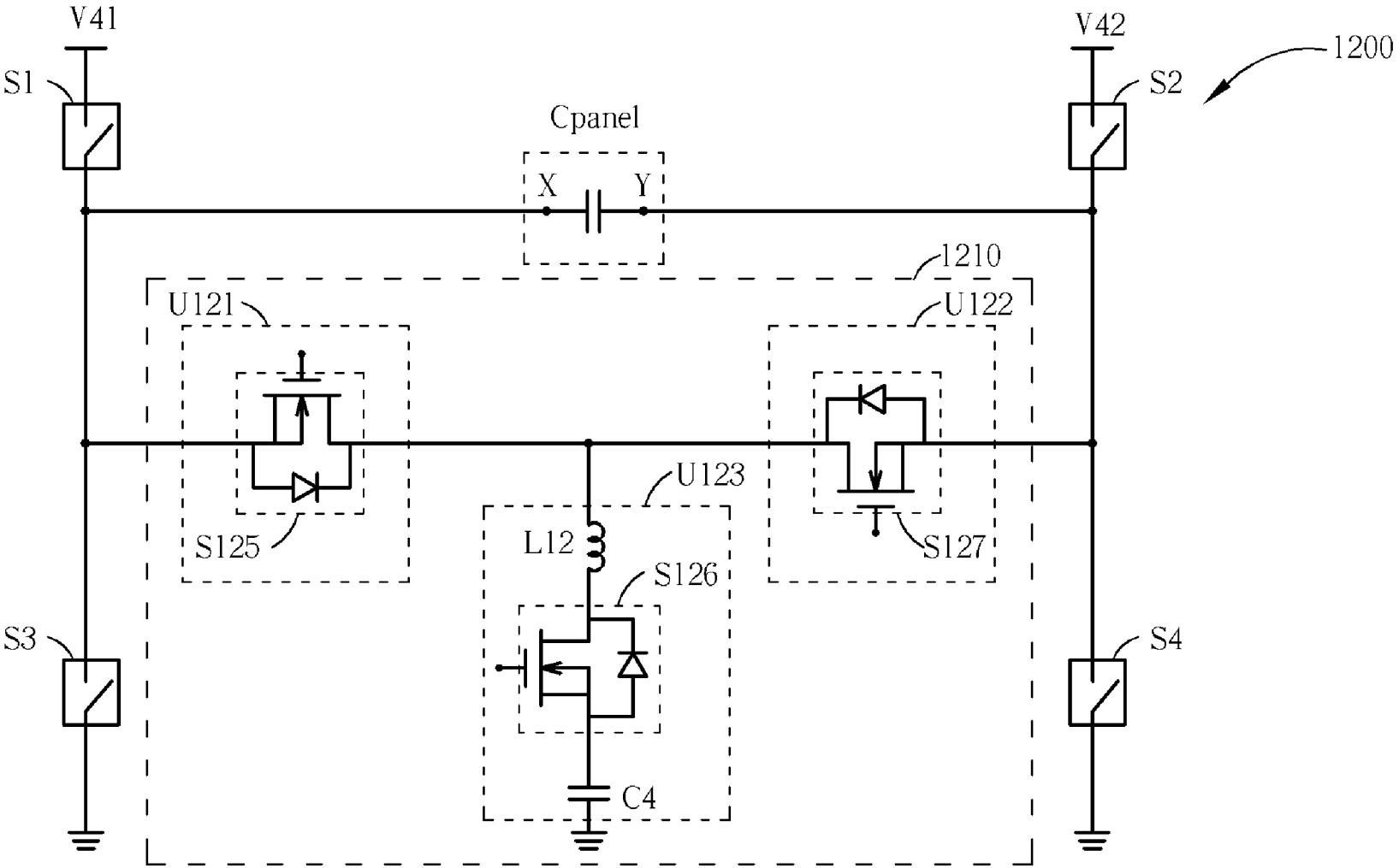
FIG. 12 is a block diagram of a seventh embodiment of the present invention driver circuit with an equivalent capacitor of a PDP.

Please refer to FIG. 12. FIG. 12 is a block diagram of another embodiment 1200 of the present invention driver circuit with an equivalent capacitor Cpanel of a PDP. In this embodiment, not only the inductor L12, but also the switch S126 is adopted in both the energy recovery circuit of the X-side of the capacitor Cpanel and the energy recovery circuit of the Y-side of the capacitor Cpanel as well. When charging the X side of the capacitor Cpanel by the capacitor C4 and keeping the voltage potential at the Y side of the capacitor Cpanel at ground, the switches S125 and S4 are turned on. When discharging the X side of the capacitor Cpanel to ground and keeping the voltage potential at the Y side of the capacitor Cpanel at ground, the switches S126 and S4 are turned on. When charging the Y side of the capacitor Cpanel by the capacitor C4 and keeping the voltage potential at the X side of the capacitor Cpanel at ground, the switches S127 and S3 are turned on. And when discharging the Y side of the capacitor Cpanel to ground and keeping the voltage potential at the X side of the capacitor Cpanel at ground, the switches S126 and S3 are turned on. The amount of adopted components is further decreased.

In the embodiments 500, 800, 900, 1000, 1100 and 1200 of the present invention driver circuit, for each side of the capacitor Cpanel, the energy forward channel and the energy backward channel share only one inductor. Therefore the slopes of the curves of the voltage potential in the charging stage and in the discharging stage are of the same absolute value. Furthermore, if the inductances of the inductors utilized to charge the X side of the capacitor Cpanel and the Y side of the capacitor Cpanel are the same, or if the inductor utilized to charge the X side of the capacitor Cpanel is the same as the inductor utilized to charge the Y side of the capacitor Cpanel, the slopes of the curves of the voltage potentials at the X side and the Y side in the charging stages and the discharging stages will be the same. Contrarily, if the inductor utilized to charge the X side of the capacitor Cpanel is different from the inductor utilized to charge the Y side of the capacitor Cpanel, and the two inductances are different, the slopes of the curves of the voltage potentials at the X side of the equivalent capacitor in the charging stages and the slopes of the curves of the voltage potentials at the Y side of the equivalent capacitor in the charging stages will be different. That is, the slopes of the voltage curves at the X side and the Y side of the equivalent capacitor can be well controlled by adopting appropriate inductors. The embodiments 900, 1000 and 1200 of the claimed driver circuit are examples.

In summary, the claimed invention provides a driver circuit that utilizes only one capacitor for serving in all of energy-forward channels and energy-backward channels of the X side and the Y side of the equivalent capacitor of a plasma display panel. The required amount of utilized components in the present invention energy recovery circuit and the number of control ICs are decreased accordingly, while the recovery rate of energy is maintained. Different variations of the order and connections of the switches and inductors are introduced for different advantages. Therefore, the important task of power saving in the PDP display is achieved more efficiently and with lower cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driver circuit comprising:

a first switch having a first end coupled to a first voltage source and a second end coupled to an X side of an equivalent capacitor of a plasma display panel;

a second switch having a first end coupled to a second voltage source and a second end coupled to a Y side of the equivalent capacitor of the plasma display panel;

a third switch having a first end coupled to the second end of the first switch and a second end coupled to ground;

a fourth switch having a first end coupled to the second end of the second switch and a second end coupled to ground; and an energy recovery circuit comprising:

a first unit, coupled to the X side of the equivalent capacitor, for passing current of charging and/or discharging the equivalent capacitor from the X side;

a second unit, coupled to the Y side of the equivalent capacitor, for passing current of charging and/or discharging the equivalent capacitor from the Y side; and a third unit coupled to the first unit, the second unit and ground, the third unit comprising a capacitor, capable of charging and/or discharging the equivalent capacitor from the X side and/or the Y side.

2. The driver circuit of claim 1 wherein the first unit comprises:

a fifth switch for passing current toward the X side of the equivalent capacitor;

a sixth switch for passing current toward the third unit; and an inductor;

wherein the fifth switch, the sixth switch and the inductor are coupled in series.

3. The driver circuit of claim 1 wherein the second unit comprises:

a seventh switch for passing current toward the Y side of the equivalent capacitor;

an eighth switch for passing current toward the third unit; and an inductor;

wherein the seventh switch, the eighth switch and the inductor are coupled in series.

4. The driver circuit of claim 1 wherein the first unit comprises:

a first branch comprising:

a fifth switch for passing current toward the X side of the equivalent capacitor; and a first inductor coupled to the fifth switch in series; and a second branch comprising:

a sixth switch for passing current toward the third unit; and a second inductor coupled to the sixth switch in series;
wherein the first branch and the second branch are coupled in parallel.

5. The driver circuit of claim 4 wherein the inductances of the first inductor and the second inductor are different.

6. The driver circuit of claim 4 wherein the inductances of the first inductor and the second inductor are the same.

7. The driver circuit of claim 1 wherein the second unit comprises:

a third branch comprising:

a seventh switch for passing current toward the Y side of the equivalent capacitor; and a third inductor coupled to the seventh switch in series; and a fourth branch comprising:

an eighth switch for passing current toward the third unit; and a fourth inductor coupled to the eighth switch in series;

wherein the third branch and the fourth branch are coupled in parallel.

8. The driver circuit of claim 7 wherein the inductances of the third inductor and the fourth inductor are different.

9. The driver circuit of claim 7 wherein the inductances of the third inductor and the fourth inductor are the same.

10. The driver circuit of claim 1 wherein the first unit comprises:

an inductor; and a pair of switches comprising:

a fifth switch for passing current toward the X side of the equivalent capacitor; and a sixth switch coupled to the fifth switch in parallel for passing current toward the third unit;

wherein the inductor is coupled to the pair of switches.

11. The driver circuit of claim 1 wherein the second unit comprises:

an inductor; and a pair of switches comprising:

a seventh switch for passing current toward the Y side of the equivalent capacitor; and an eighth switch coupled to the seventh switch in parallel for passing current toward the third unit;

wherein the inductor is coupled to the pair of switches.

12. The driver circuit of claim 1 wherein the first unit comprises:

a fifth switch for passing current toward the X side of the equivalent capacitor; and a sixth switch, serially coupled to the fifth switch for passing current toward the third unit;

and the third unit further comprises an inductor serially coupled to the capacitor.

13. The driver circuit of claim 1 wherein the second unit comprises:

a seventh switch for passing current toward the Y side of the equivalent capacitor; and an eighth switch, serially coupled to the seventh switch for passing current toward the third unit;

and the third unit further comprises an inductor serially coupled to the capacitor.

14. The driver circuit of claim 1 wherein the first unit comprises:

a fifth switch for passing current toward the X side of the equivalent capacitor; and a sixth switch coupled to the fifth switch in parallel for passing current toward the third unit;

and the third unit further comprises an inductor serially coupled to the capacitor.

15. The driver circuit of claim 1 wherein the second unit comprises:

a seventh switch for passing current toward the Y side of the equivalent capacitor; and an eighth switch coupled to the seventh switch in parallel for passing current toward the third unit;

and the third unit further comprises an inductor serially coupled to the capacitor.

16. The driver circuit of claim 1 wherein the first unit comprises:

a fifth switch for passing current toward the X side of the equivalent capacitor; and a first inductor coupled to the fifth switch serially;

the second unit comprises:

a seventh switch for passing current toward the Y side of the equivalent capacitor; and a second inductor coupled to the seventh switch serially; and the third unit further comprises:

a sixth switch for passing current from the X side and/or the Y side of the equivalent capacitor;

wherein the capacitor and the sixth switch are coupled in series.

17. The driver circuit of claim 16 wherein the inductances of the first inductor and the second inductor are different.

18. The driver circuit of claim 16 wherein the inductances of the first inductor and the second inductor are the same.

19. The driver circuit of claim 1 wherein the first unit comprises:

a fifth switch for passing current toward the third unit; and a first inductor coupled to the fifth switch serially;

the second unit comprises:

a seventh switch for passing current toward the third unit; and a second inductor coupled to the seventh switch serially; and the third unit further comprises:

a sixth switch for passing current toward the X side and/or the Y side of the equivalent capacitor;

wherein the capacitor and the sixth switch are coupled in series.

20. The driver circuit of claim 19 wherein the inductances of the first inductor and the second inductor are different.

21. The driver circuit of claim 19 wherein the inductances of the first inductor and the second inductor are the same.

22. The driver circuit of claim 1 wherein the first unit comprises:

a fifth switch for passing current toward the X side of the equivalent capacitor;

the second unit comprises:

a seventh switch for passing current toward the Y side of the equivalent capacitor; and the third unit further comprises:

an inductor; and a sixth switch for passing current from the X side and/or the Y side of the equivalent capacitor;

wherein the capacitor, the inductor and the sixth switch are coupled in series.

23. The driver circuit of claim 1 wherein the first unit comprises:

a fifth switch for passing current toward the third unit;

the second unit comprises:

a seventh switch for passing current toward the third unit; and the third unit further comprises:

an inductor; and a sixth switch for passing current toward the X side and/or the Y side of the equivalent capacitor;

wherein the capacitor, the inductor and the sixth switch are coupled in series.

* * * * *